US009231300B1

(12) United States Patent
Tam et al.

(10) Patent No.: US 9,231,300 B1
(45) Date of Patent: Jan. 5, 2016

(54) GROUNDED MAST CLAMP CURRENT PROBE ELECTROSTATIC SHIELD COUNTERPOISE

(71) Applicants: Daniel Wing Shum Tam, San Diego, CA (US); Yinuo James Chen, San Diego, CA (US); David Russell Hilton, Carlsbad, CA (US)

(72) Inventors: Daniel Wing Shum Tam, San Diego, CA (US); Yinuo James Chen, San Diego, CA (US); David Russell Hilton, Carlsbad, CA (US)

(73) Assignee: United States of America as Represented by the Secretary of the Navy, Washington, DC (US)

( * ) Notice: Subject to any disclaimer, the term of this patent is extended or adjusted under 35 U.S.C. 154(b) by 307 days.

(21) Appl. No.: 14/037,452

(22) Filed: Sep. 26, 2013

(51) Int. Cl.
*H01Q 1/48* (2006.01)

(52) U.S. Cl.
CPC ..... *H01Q 1/48* (2013.01)

(58) Field of Classification Search
CPC ..... H01Q 1/364; H01Q 1/48; H01Q 5/30; H01Q 9/34; H01Q 9/38; H01Q 9/44; H01Q 19/28
See application file for complete search history.

(56) References Cited

U.S. PATENT DOCUMENTS

| | | | | |
|---|---|---|---|---|
| 4,149,169 | A * | 4/1979 | Weber | H01Q 9/38 343/725 |
| 5,633,648 | A | 5/1997 | Fischer | |
| 6,492,956 | B1 | 12/2002 | Fischer et al. | |
| 7,898,484 | B1 | 3/2011 | Tam | |
| 7,994,992 | B1 | 8/2011 | Tam et al. | |
| 8,094,083 | B1 | 1/2012 | Rockway et al. | |
| 8,164,534 | B1 | 4/2012 | Tam | |
| 8,368,605 | B1 | 2/2013 | Tam | |

OTHER PUBLICATIONS

Quick, Holly "The Seawater Antenna," CHIPS, Apr.-Jun. 2011 p. 54.

* cited by examiner

*Primary Examiner* — Robert Karacsony
*Assistant Examiner* — Patrick Holecek
(74) *Attorney, Agent, or Firm* — SSC Pacific Patent Office; Arthur K. Samora; Kyle Eppele

(57) ABSTRACT

The present invention is a grounded mast clamp current probe apparatus. The apparatus can have a current probe substantially enclosed by at least one housing. The housing forms an electrostatic shield that prevents passage of electricity to or from the current probe. A plurality of grounding elements are connected to the outer surface of the housing and radiate outwardly from the outer circumference of the housing. Each of the grounding elements radiates at a frequency angle θ, the angle formed between a longitudinal axis of the housing and a longitudinal axis of the grounding elements. The bandwidth and resonant frequency of the current probe is dependent on the frequency angle θ.

18 Claims, 8 Drawing Sheets

$H_M$

GROUNDED MAST CLAMP CURRENT PROBE ELECTROSTATIC SHIELD COUNTERPOISE

FEDERALLY-SPONSORED RESEARCH AND DEVELOPMENT

This invention is assigned to the United States Government. Licensing inquiries may be directed to Office of Research and Technical Applications, Space and Naval Warfare Systems Center, Pacific, Code 72120, San Diego, Calif., 92152; telephone (619) 553-5118; email: ssc_pac_t2@navy.mil. Reference Navy Case No. 101613.

BACKGROUND

1. Field

This invention relates to the field of radio wave antennas, and more specifically, to adaptive technology for grounding and increasing the bandwidth of currently-deployed antenna structures.

2. Background

Antennas deployed by the U.S. Navy must interface with commercial communications systems. The ability to interface currently deployed military and civilian technology is critical to command control functions. However, a growing number of commercial communications systems utilize bandwidths that existing military antennas cannot match.

The Navy's Space and Naval Warfare Systems Command (SPAWAR) can have developed technology to adapt existing antennas to provide increased bandwidth and a critical communications interface. One exemplary technology developed by SPAWAR is the Mast Clamp Current Probe (MCCP), disclosed in U.S. Pat. No. 8,164,534 issued to Daniel Tam (Tam '534) and U.S. Pat. No. 7,994,992 issued to Daniel Tam et al. (Tam '992), the contents of which are incorporated herein by reference in their entirety. Tam '534 and Tam '992 teach an adaptive device that can be mounted to existing antennas to convert them to multiband capability without the downtime or redeployment costs typically associated with such capability. Tam '534 and Tam '992 teach a method and devices through which probes, transmitting lines, and receiving lines can be operatively coupled with existing antennas to increase the frequency range and the number of transmission and receiving lines to the number necessary to interface with private sector technology.

One problem overcome by the MCCP device is that it improves the voltage standing wave ratio (VSWR) along a transmission line leading to the antenna.

Bandwidth, associated with the addition of transmission and receiving components, generally results in an increase in the measurable VSWR. However, as bandwidth and corresponding VSWR increase, it is known in the art that large amounts of power can be reflected to the transmission line. Large amounts of reflected power can damage the radio-transmitting systems. Tam '534 and Tam '992 taught a method and apparatus capable of controlling VSWR associated with bandwidth while preventing damage to the radio.

It is a problem known in the art that MCCP-enabled systems must be effectively grounded to form a complete circuit for transmission, and in such a manner that the systems are safe for use aboard a ship. Grounding methods and components in the art that alter the structure of the MCCP system also affect the critical frequencies achieved by the MCCP structures. Grounding structures known in the art (referred to as counterpoises) achieve unpredictable results and compromise mission-critical transmissions.

It desirable to have an MCCP-enabled system that is capable of being grounded and maintaining accurate, mission-critical transmission.

SUMMARY OF THE INVENTION

The present invention is a grounded mast clamp current probe apparatus. The apparatus can have a current probe substantially enclosed by at least one housing. This housing forms an electrostatic shield which prevents passage of electricity to or from the current probe. A plurality of grounding elements are connected to the outer surface of the housing and radiate outwardly from the outer circumference of the housing. Each of the grounding elements radiates at a frequency angle θ, the angle formed between a longitudinal axis of the housing and a longitudinal axis of the grounding elements. The bandwidth and resonant frequency of the current probe is dependent on the frequency angle θ.

TERM OF ART

As used herein, the term "Mast Clamp Current Probe (MCCP)" is defined as an adaptive device for an antenna, taught by U.S. Pat. No. 8,164,534 and U.S. Pat. No. 7,994,992 (both hereinafter incorporated by reference), which operatively couples current probes, transmitting lines, and receiving lines to existing antennas to increase the frequency range and bandwidth.

DETAILED DESCRIPTION OF INVENTION

Figure 1:
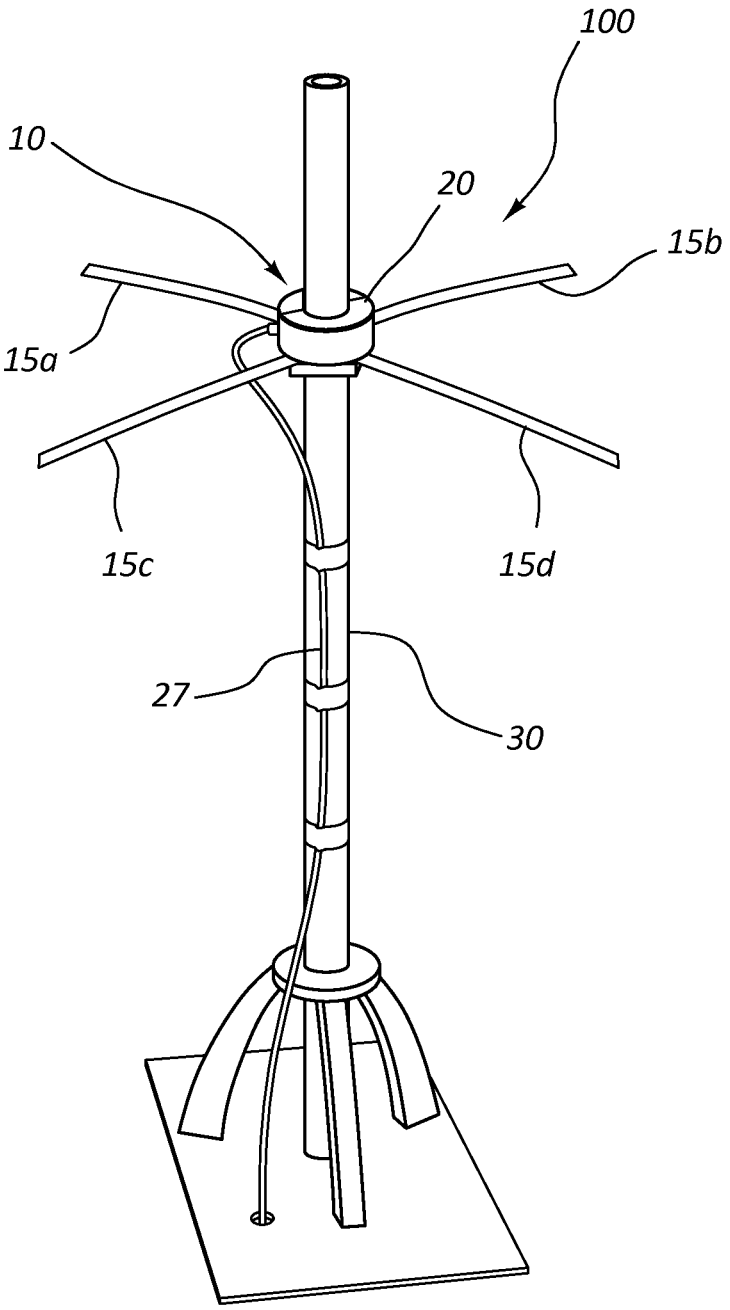
FIG. 1 illustrates a side view of an exemplary embodiment of a grounded MCCP system with grounding elements that are strip-shaped.
Figure 2:
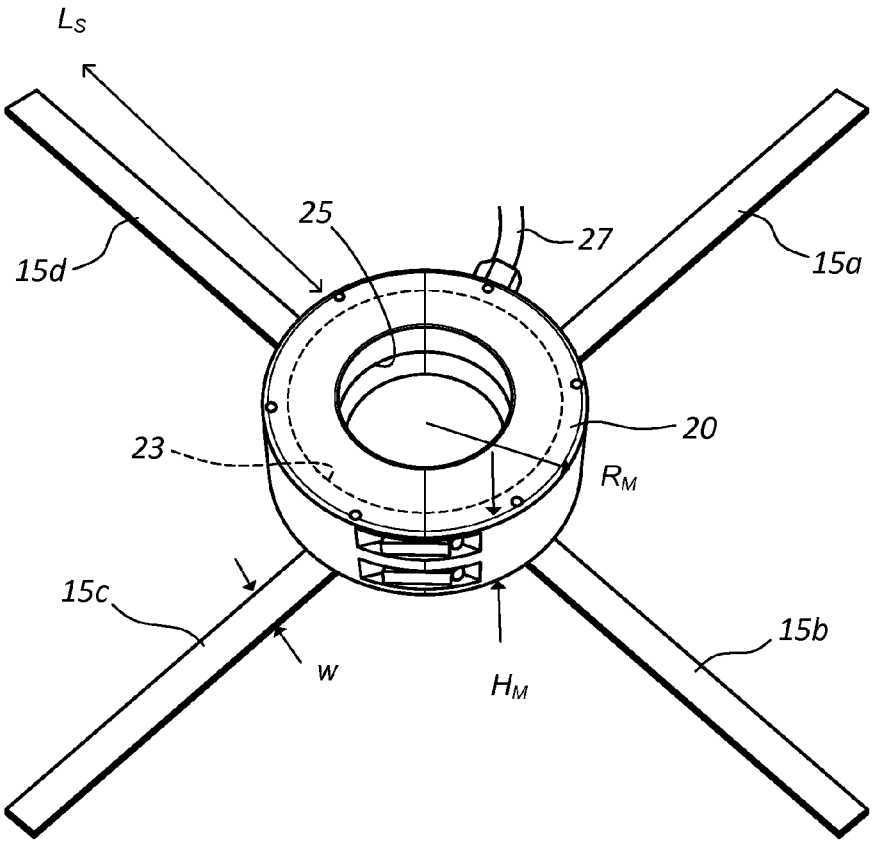
FIG. 2 illustrates a top view of an exemplary embodiment of a grounded MCCP wherein a slit and current probe are visible.

FIGS. 1 and 2 illustrate a side view of an exemplary embodiment of a grounded MCCP system with grounding elements that are strip-shaped. As illustrated in FIGS. 1 and 2, grounded MCCP system 100 can be composed of an MCCP 10 mounted to an antenna 30. MCCP 10 is made up of housing 20, a current probe 23 (seen in FIG. 2), at least one cable 27, and a plurality of strip-shaped grounding elements 15*a* through 15*d* forming a counterpoise.

Housing 20 can form an electrostatic shield, substantially preventing the passage of electricity to or from the current probe 23. In the exemplary embodiment shown, a weight-bearing support component (not shown) selectively mounts housing 20 to antenna 30. In other embodiments, housing 20 may be permanently attached to antenna 30.

As illustrated in FIGS. 1 and 2, a cable 27 encloses a single frequency transmitting and receiving line pair operatively coupled to the current probe 23. Alternative embodiments may include more or fewer line pairs and different physical configurations of cable 27. In other embodiments, cable 27 may be located inside of antenna 30.

FIG. 1 also illustrates strip-shaped grounding elements 15*a* through 15*d*, which store current during signal transmission or reception. These elements provide a ground plane for the MCCP without interfering with MCCP transmission or reception, as they are integrally attached to the outside of housing 20 and therefore outside of the electrostatic shield. Strip-shaped grounding elements 15*a* through 15N can be attached to the outside of housing 20 with conductive tape, solder or conductive adhesives (note that FIG. 1 only depicts grounding elements 15*a* through 15*d*, but the illustration of four grounding elements in the Figures is not intended to be an implied restriction on the present invention according to several embodiments. In another contemplated embodiment, the strip-shaped grounding elements 15*a* through 15*d* are attached by removable screws or bolts to housing 20. The screws or bolts fit through matching and aligned holes in strip-shaped grounding elements 15*a* through 15*d* and housing 20. This enables removal of strip-shaped grounding elements 15*a* through 15*d* for transportation or storage when not needed, as well as replacement of damaged strip-shaped grounding elements 15*a* through 15*d* or alteration of the angle of the strip-shaped grounding elements 15*a* through 15*d*. Interlocking, mechanical and integrally machined strip-shaped grounding elements 15*a* through 15*d* are also contemplated.

While the above exemplary embodiments of FIG. 1 form the strip-shaped grounding elements 15*a* through 15*d* from brass, materials in other contemplated embodiments may be, but are not limited to, copper, aluminum and other metallic materials. While the above exemplary embodiments utilize four strip-shaped grounding elements 15*a* through 15*d*, other contemplated embodiments may use any number from about four to about three hundred. A larger number of strip-shaped grounding elements reduce the size of the space between the strip-shaped grounding elements to closely emulate a ground plane structure.

Exemplary embodiments of FIG. 1 utilize flat, ribbon-like strip-shaped grounding elements 15*a* through 15*d* with a rectangular cross-section. In alternative embodiments, cross section shapes may include, but are not limited to, circular, square, octagon, geometrically-optimized and irregularly-shaped cross-sections.

While strip-shaped grounding elements 15*a* through 15*d* of the above embodiment of FIG. 1 are approximately 1-inch wide, in alternative embodiments, strip-shaped grounding elements 15*a* through 15*d* may have a width w (See FIG. 2) ranging from about 0.25 inches to about 12 inches. In various embodiments, the width of strip-shaped grounding elements 15*a* through 15*d* may be identified as a dependent upon the width of the housing 20, being at most about one-half of the diameter of housing 20. Strip-shaped grounding elements 15*a* through 15*d* may have a length dependent upon the frequency intended to be transmitted from antenna 30. A formula for determining the length of strip-shaped grounding elements 15*a* through 15*d* is:

$$L_s=(c/(4f))-(R_M+H_M)$$

where $L_s$ is the length of strip-shaped grounding elements 15*a* through 15*d*, *c* is the speed of light, f is the transmission frequency, $R_M$ is the radius of the MCCP and $H_M$ is the height of the MCCP, the measurement from base to top (See FIG. 2).

As illustrated in FIG. 1, antenna 30 is a mast structurally configured to form an antenna. The exemplary antenna illustrated in FIG. 1 is a traditional, metal, monopole antenna. In alternative embodiments, antenna 30 may be a dipole and grounded metal pole, an electrolytic fluid antenna, or any structure that may be adapted to function as an antenna. Various embodiments of an electrolytic fluid antenna are contemplated in U.S. Pat. No. 7,898,484 issued to Daniel Tam (Tam '484), the contents of which are incorporated herein by reference in their entirety. In various embodiments, antenna 30 can have at minimum a shaft and a frequency range. Each pair of frequency transmitting and receiving lines within cable 27 can have a distinct frequency within the antenna 30 frequency range.

FIG. 2 illustrates a top view of an exemplary embodiment of a grounded MCCP wherein a slit and current probe are visible. FIG. 2 illustrates a housing 20, current probe 23, slit 25 and the radial pattern of strip-shaped grounding elements 15*a* through 15*d*.

The exemplary embodiment shown in FIG. 2 utilizes a current probe 23 and corresponding housing 20 that are ring-shaped. In the embodiment shown, ring-shaped current probe 23 produces a relatively even magnetic field that is optimized by the lack of corners (angled paths) characteristic of a ring shape. Alternative contemplated embodiments may utilize angled geometric configurations to optimize current flow for mast structures that have angular cross-sections. Alternative embodiments of the current probe may be, but are not limited to, square-shaped and octagon-shaped, or the geometry and dimensions of the current probe can be adapted to conform to the antenna 30.

In the embodiment shown in FIG. 2, housing 20 includes slit 23 located on the inner side of housing 20 adjacent to antenna 30 (shown above in FIG. 1). In this embodiment, slit 23 permits passage of induced voltage necessary for antenna 30 transmissions.

Figure 3A:
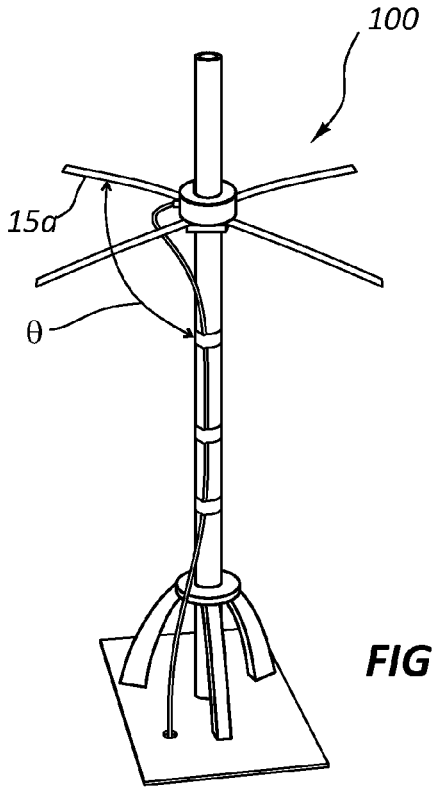
FIGS. 3*a* through 3*c* illustrate three alternative embodiments for placement of strip-shaped grounding elements at varying frequency angles 8.
Figure 3B:
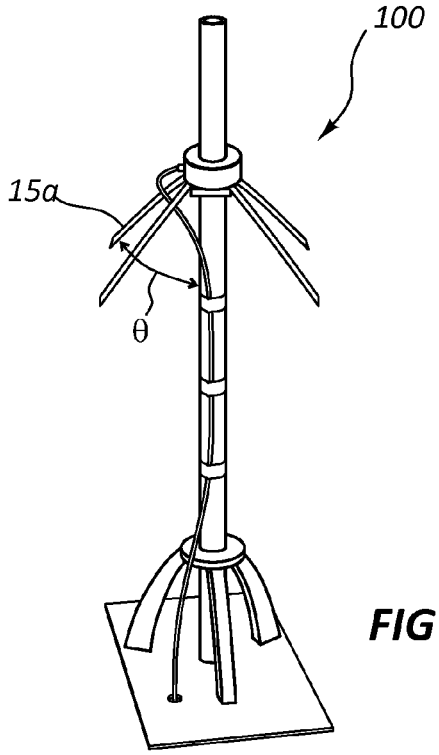
Figure 3C:
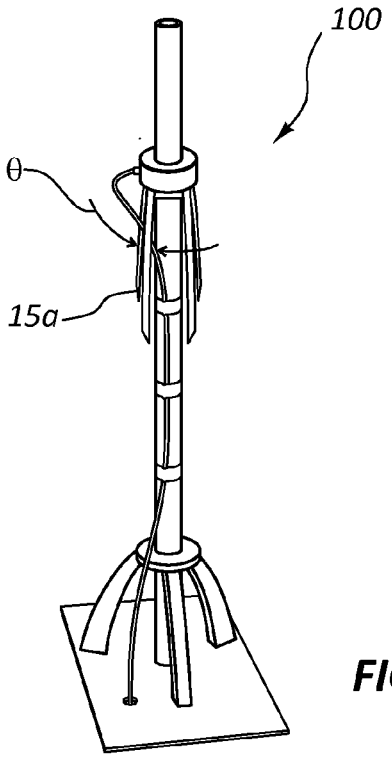

FIGS. 3*a* through 3*c* illustrate three alternative embodiments for placement of strip-shaped grounding elements at varying frequency angles 8. FIGS. 3*a* through 3*c* illustrate the angles formed by the position of strip-shaped grounding elements 15*a* through 15*d* to the longitudinal axis of housing 20. As shown, the longitudinal axis of housing 20 can be coincident with an axis defined by the antenna when MCCP 10 is installed on antenna 30. Stated differently, angle θcan be substantially the angle formed between element 15 and antenna 30. The angle formed by strip-shaped grounding elements 15*a* through 15*d* alters the resonant frequency and bandwidth of MCCP 10. This angle is known as the frequency angle θ. For clarity, only strip-shaped grounding element 15*a* is labeled; however, all strip-shaped grounding elements 15*a* through 15*d* form the same frequency angle θ with the longitudinal axis of housing 20.

FIG. 3*a* illustrates an exemplary embodiment of a grounded MCCP system 100 in which strip-shaped grounding elements 15*a* through 15*d* are positioned parallel to the ground at a frequency angle θ of 90 degrees.

FIG. 3*b* illustrates an exemplary embodiment of a grounded MCCP system 100 in which strip-shaped grounding elements 15*a* through 15*d* are positioned at a frequency angle θ of 45 degrees.

FIG. 3*c* illustrates an exemplary embodiment of a grounded MCCP system 100 in which strip-shaped grounding elements 15*a* through 15*d* are positioned perpendicular to the ground at a frequency angle θ of 0 degrees.

As illustrated in FIGS. 3*a* through 3*c*, variations in frequency angle θ are possible. In various embodiments, frequency angle θcan be a function of various feature limitations including, but not limited to, the position of MCCP 10 along antenna 30 and the frequency and bandwidth of the desired transmission signal.

Figure 4:
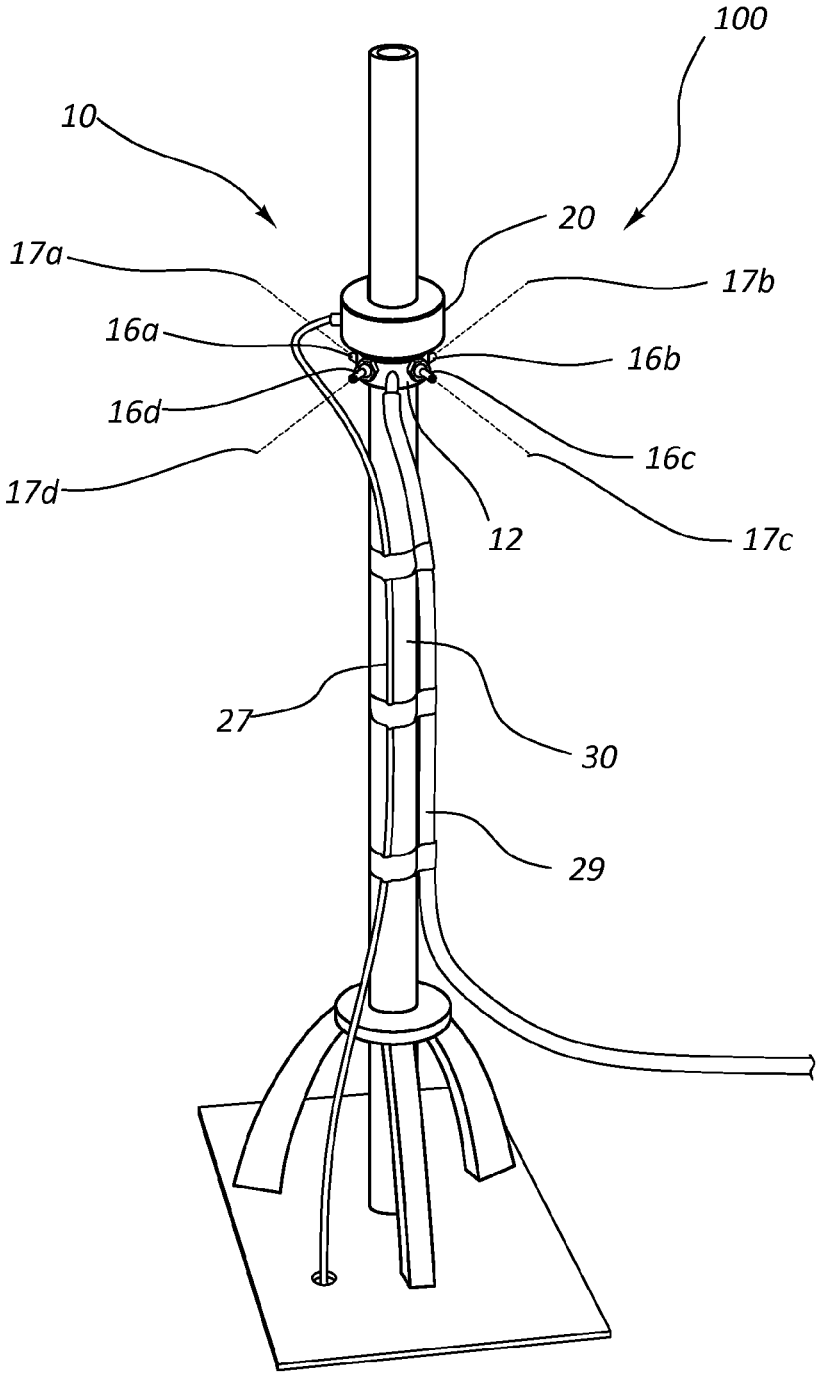
FIG. 4 illustrates an alternative exemplary embodiment of a grounded MCCP system that utilizes electrolytic fluid streams as grounding elements.

FIG. 4 illustrates an alternative exemplary embodiment of a grounded MCCP system 100 that utilizes electrolytic fluid streams as grounding elements. In this exemplary embodiment, the grounding elements are four streams 17*a* through 17*d* expelled from nozzles 16*a* through 16*d* connected to housing 20 by manifold 12. A tube 29 delivers material for streams 17*a* through 17*d* to manifold 12.

As illustrated by FIG. 4, streams 17*a* through 17*d* are expelled to create the grounding elements that make up a counterpoise. The nozzles 16 can be formed with apertures (not shown in the Figures) which can be configured to establish streams 17 having a width ranging from about 0.25 inches to about 12 inches, when the embodiment is viewed in top plan. Streams 17*a* through 17*d* can also be composed of an electrolytic fluid such as, but not limited to, seawater or a similar ionic solution. The temperature of the electrolytic fluid can typically range from about 32 degrees F. to about 80 degrees F., with higher temperatures increasing the electrolytic fluid conductance.

The exemplary embodiment of FIG. 4 utilizes nozzles 16*a* through 16*d*, which are connected to manifold 12 through a rotating or swiveling joint so that the frequency angle θ may be adjusted. Nozzles 16*a* through 16*d* may have a radiation angle θranging from about 0 degrees to about 90 degrees. In various embodiments, frequency angle θ is a function of various feature limitations including, but not limited to, the position of MCCP 10 along antenna 30 and the frequency and bandwidth of the desired transmission signal. Alternative embodiments can include a rotating or swiveling joint, which can selectively establish nozzles 16 at angle θ, according to the needs of the user.

While the exemplary embodiment of FIG. 4 illustrates four nozzles 16*a* through 16*d*, in other contemplated embodiments, any number of nozzles from about four to about three hundred may be used. In various alternative embodiments, an increased number of nozzles may reduce the width of streams 17, or may reduce the space between fluid streams to closely emulate a ground plane structure.

While the above embodiment of FIG. 4 utilizes approximately 1-inch wide fluid-expelling apertures of nozzles 16*a* through 16*d*, in other contemplated embodiments, apertures of the nozzles 16*a* through 16*d* may have a width ranging from about 0.25 inches to about 12 inches. The width of apertures of nozzles 16*a* through 16*d* may also be determined as dependent upon the width of the MCCP 10, being at most about one-half of the diameter of the MCCP 10. The length of streams 17*a* through 17*d* expelled from nozzles 16*a* through 16*d* may be dependent upon the frequency intended to be transmitted from antenna 30. A formula for determining the length of streams 17*a* through 17*d* is:

$$L_f=(250\times\sqrt{(10/(f(\sigma)))}-(R_M+H_M)$$

where $L_f$ is the length of streams 17*a* through 17*d*, *f* is the transmission frequency, a is the fluid electrical conductivity, $R_M$ is the radius of the MCCP and $H_M$ is the height of the MCCP, the measurement from base to top.

In the exemplary embodiment of FIG. 4, manifold 12 may be operatively connected to housing 20 by an attachment means selected from a group consisting of conductive tape, soldering, conductive adhesive, screws, bolts, and interlocking, mechanical and integrally-machined components.

In the exemplary embodiment of FIG. 4, tube 29 is shown to be outside antenna 30, but may also be located inside antenna 30 in alternate embodiments.

Figure 5:
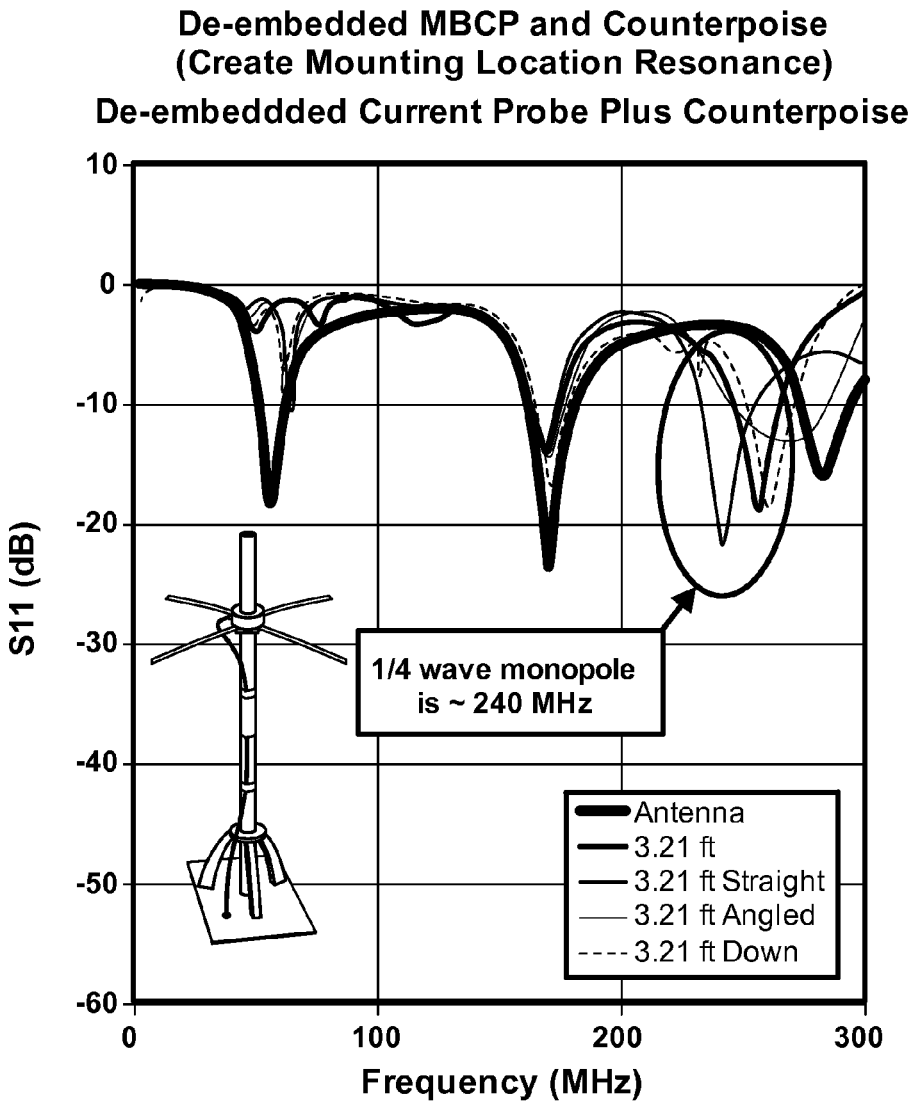
FIG. 5 illustrates a graph of data for a grounded MCCP system that shows an exemplary relationship of the frequency angles θ of the grounded MCCP to resonant frequency and bandwidth.

FIG. 5 illustrates a graph of data for a grounded MCCP system that shows an exemplary relationship of the frequency angles θ of the grounded MCCP to resonant frequency and bandwidth. The data in FIG. 5 documents that the addition of grounding elements, which form a counterpoise, changes the transmission capabilities of the MCCP based on the frequency angle θ. The embodiments shown in FIG. 5 utilize frequency angles θ of 90 degrees (straight), 45 degrees (angled) and 0 degrees (down). As FIG. 5 illustrates, in the embodiment having a frequency angle θ of 90 degrees an additional resonance frequency occurs near 240 MHz. Thus, in various embodiments the use of a counterpoise made up of grounding elements in an MCCP system can induce a new resonance frequency.

As FIG. 5 also illustrates, utilizing a frequency angle θ of 45 degrees also increases MCCP transmission bandwidth. In various embodiments, introduction of grounding elements may therefore provide an advantage when transmitting distinct from the grounding capability of the structure.

Figure 6A:
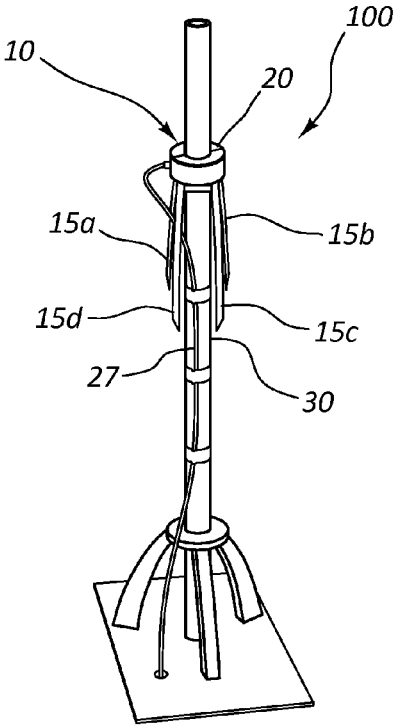
FIGS. 6*a* and 6*b* illustrate two alternative embodiments of an antenna structure for a grounded MCCP system where antenna length can have been varied.
Figure 6B:
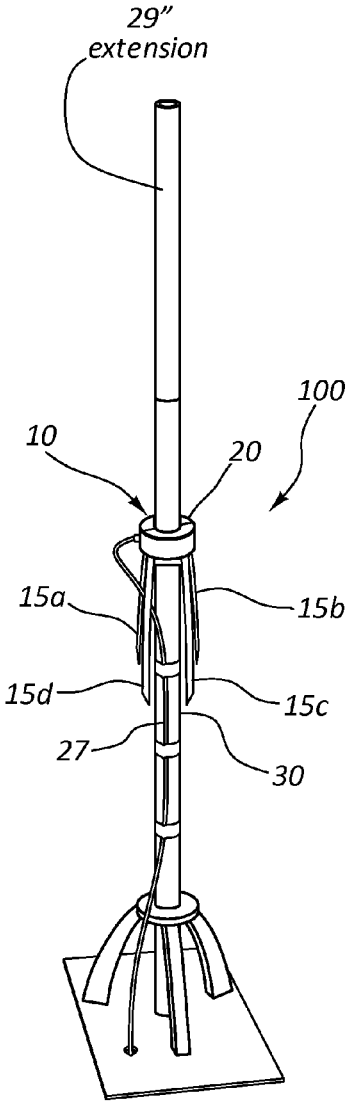

FIGS. 6*a* and 6*b* illustrate two alternative embodiments of an antenna structure for a grounded MCCP system where antenna length can be varied. The change in antenna length alters the resonance frequency produced by the addition of grounding elements that form a counterpoise. The antenna length of the embodiment of FIG. 6*a* is approximately 12 inches, while the antenna length of the embodiment of FIG. 6*b* can be extended to approximately 41 inches.

Figure 7:
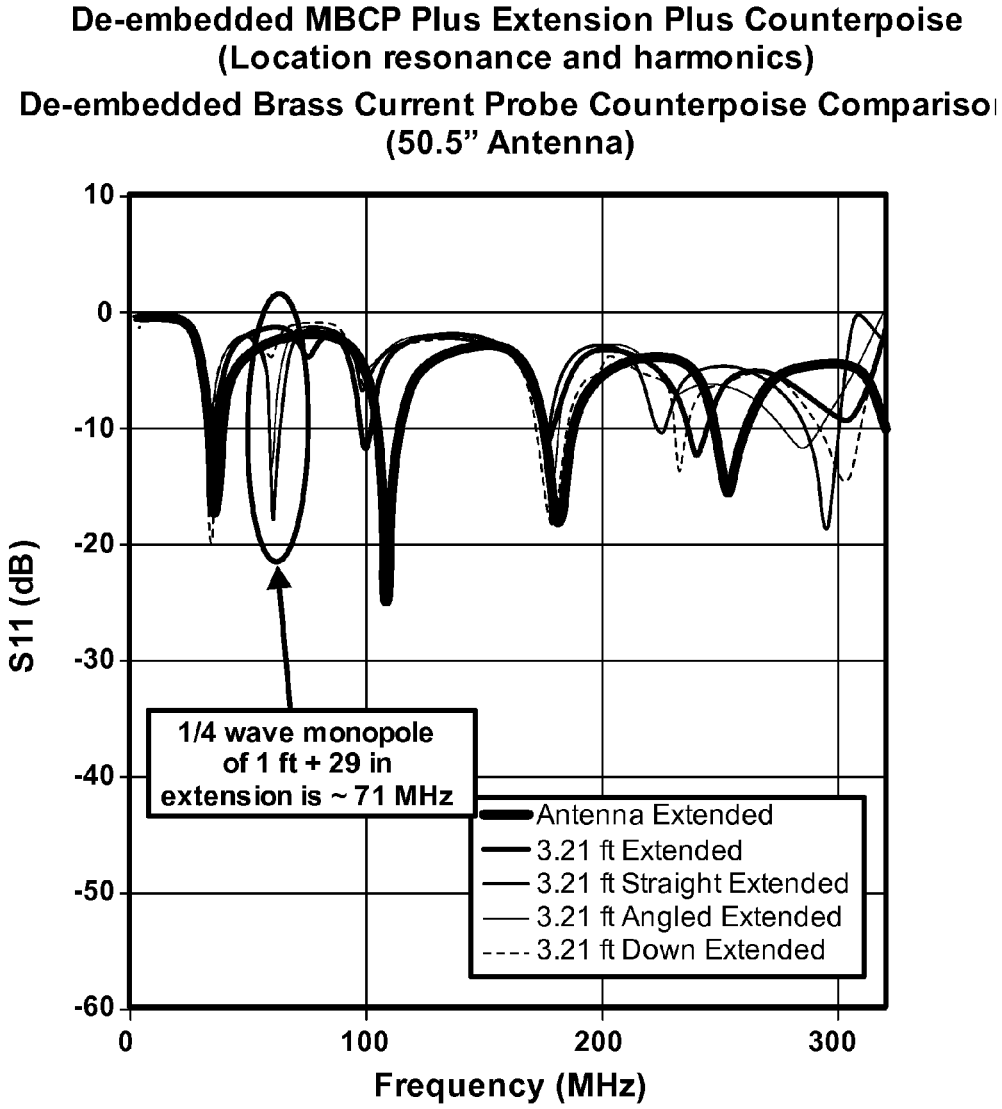
FIG. 7 illustrates a graph of data for a grounded MCCP system which shows an exemplary relationship of the length of the antenna to resonant frequency and bandwidth for a grounded MCCP system.
Figure 8:
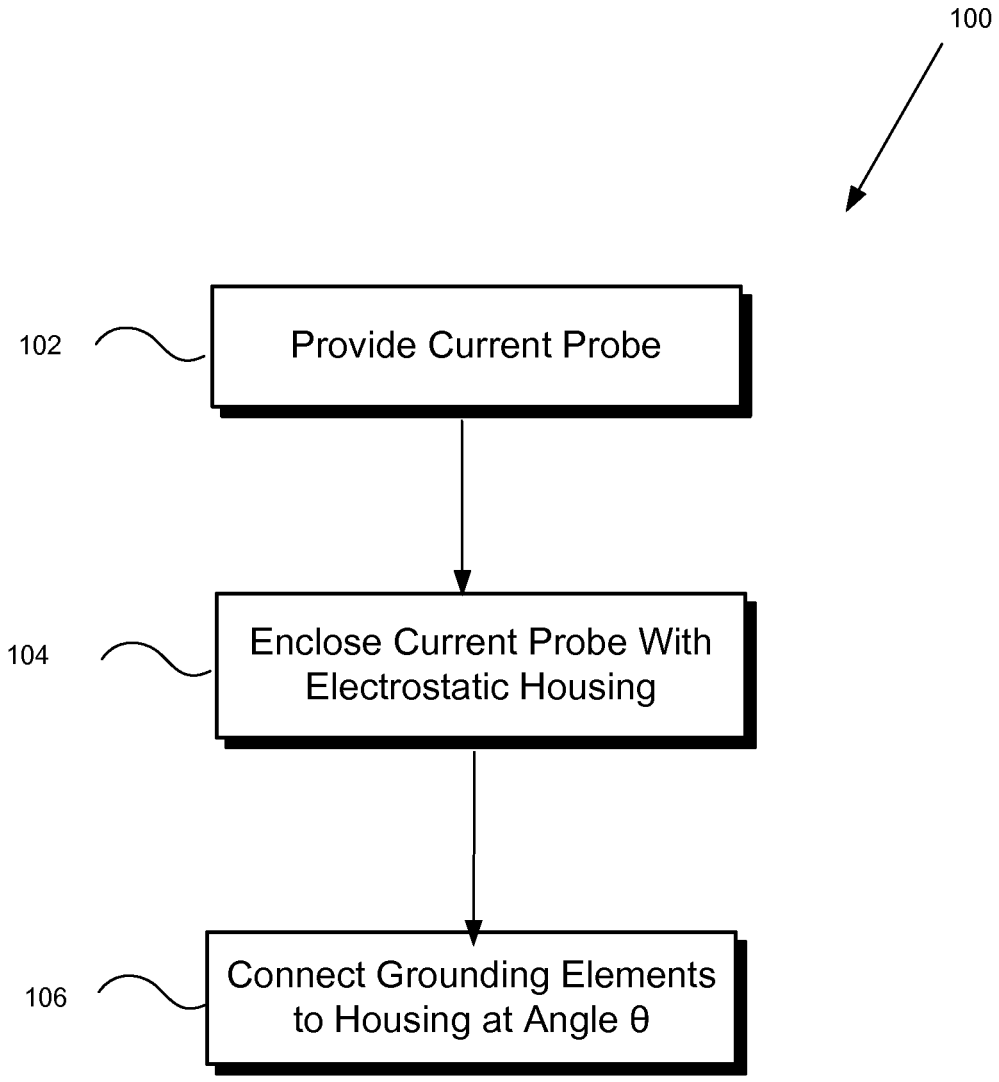
FIG. 8 is a block diagram of steps that can be taken to accomplish the methods of the present invention according to several embodiments.

FIG. 7 illustrates a graph of data for a grounded MCCP system that shows an exemplary relationship of the length of the antenna to resonant frequency and bandwidth for a grounded MCCP system. FIG. 7 illustrates that a 12-inch antenna with a 29-inch extension produces a resonant frequency of 71 MHz. A 12-inch length produces a resonant frequency of ~240 MHz as seen above. The data gathered from this extended-antenna exemplary embodiment indicates that extending the antenna length with various counterpoise configurations may induce new resonance frequencies. To accomplish this, an antenna extension can be added or described above, or the MCCP 10 can be selectively mounted on the antenna (using an attachment means which allows for re-positioning, such as screws, for example) according to the resonant frequency desired by the user. Referring now to FIG. 8, a block diagram 100 is shown, which can be used to illustrate steps that can be taken to accomplish the methods of the present invention according to several embodiments. As shown, methods 100 can include the initial step 102 of providing a current probe. The current probe 23 can have the geometry and can be made of the materials as described above. The methods 100 can also include the steps 104 of enclosing the current probe within an electrostatic housing 20, and connecting a plurality of grounding elements 15 to housing 20, as shown by step 106. The grounding elements 15 can be oriented at an angle θ as described above, to manipulate the resulting resonant frequency bandwidth according the needs of the user. The electrostatic housing can also be mounted at different locations on antenna 30 to manipulate the resonant frequency. Or, in cases where the MCCP is permanently fixed to the antenna, the antenna can be lengthened with an extension as described above to manipulate the resonant frequency according to the needs of the user.

It will be understood that many additional changes in the details, materials, steps and arrangement of parts, which have been herein described and illustrated to explain the nature of the invention, may be made by those skilled in the art within the principal and scope of the invention as expressed in the appended claims.

What is claimed is:

1. A grounded mast current clamp probe apparatus comprising:

a current probe;

said current probe including a magnetic core formed with an aperture and a conductive structure positioned in said aperture;

at least one housing that substantially encloses said current probe, wherein said housing forms an electrostatic shield that prevents passage of electricity therethrough;

a plurality of grounding elements connected to an outer surface of said housing and radiating outwardly from an outer circumference of said housing;

wherein each of said grounding elements radiates at a frequency angle θ ranging from about 40 degrees to about 45 degrees; and, wherein said frequency angle θ is an angle formed between a longitudinal axis of said housing and a longitudinal axis of said grounding elements, wherein a bandwidth and a resonant frequency of said current probe is dependent on said frequency angle θ.

2. The apparatus of claim 1, wherein said plurality of grounding elements number from about four to about three hundred.

3. The apparatus of claim 1, wherein said plurality of grounding elements are a plurality of metallic strip-shaped grounding elements non-movably affixed to an outer surface of said housing.

4. The apparatus of claim 3, wherein each of said strip-shaped grounding elements has a length $L_s$ determined by the formula: $L_s=(c/(4f))-(R_M+H_M)$, where, c is the speed of light, f is a transmission frequency, $R_M$ is a radius of said housing and $H_M$ is a height of said housing.

5. The apparatus of claim 3, wherein each of said strip-shaped grounding elements are fabricated from a metallic material selected from a group consisting of aluminum, brass and copper.

6. The apparatus of claim 3, wherein each of said strip-shaped grounding elements has a width and each of said widths range from about 0.25 inches to about 12 inches.

7. The apparatus of claim 6, wherein each of said widths is one-half the diameter of said housing.

8. The apparatus of claim 3, wherein said strip-shaped grounding elements are coupled to said housing by an attachment means selected from a group consisting of conductive binding material, soldering, conductive adhesive, screws, bolts, interlocking, mechanical and integrally machined components.

9. The apparatus of claim 1, wherein said plurality of grounding elements are a plurality of streams of electrolytic fluid, wherein each stream is expelled through an aperture of a nozzle.

10. The apparatus of claim 9, wherein a length of said stream of electrolytic fluid is determined by the formula: $L_f=(250*\sqrt{(10/(f*\sigma))})-(R_M+H_M)$, wherein $L_f$ is a fluid stream length, f is a transmission frequency, σ is a measure of electrolytic fluid conductivity, $R_M$ is a radius of said housing and $H_M$ is a height of said housing.

11. The apparatus of claim 9, wherein said nozzles are connected at an adjustable frequency angle θ to a manifold that is non-movably affixed to an outer surface of said housing.

12. The apparatus of claim 11, wherein said manifold is coupled to said housing by an attachment means selected from a group consisting of conductive binding material, soldering, conductive adhesive, screws, bolts, interlocking, mechanical and integrally machined components.

13. The apparatus of claim 9, wherein a width of said nozzle have apertures that are adapted to spray said streams, each of said streams having a range from about 0.25 inches to about 12 inches when viewed in top plan.

14. The apparatus of claim 9, wherein a width of each of said streams is one half the diameter of said housing.

15. A grounded mast current clamp probe system comprising:

an antenna having a shaft and an antenna frequency range;

a current probe mounted to said antenna, said current probe including a magnetic core formed with an aperture and a conductive structure positioned in said aperture;

at least one housing mounted to said antenna that substantially encloses said current probe, wherein said housing forms an electrostatic shield that prevents passage of electricity to or from said current probe;

a plurality of grounding elements connected to an outer surface of said housing and radiating outwardly from an outer circumference of said housing, wherein each of said grounding elements radiates at a frequency angle θ; and, wherein said frequency angle θ is an angle formed between said shaft and a longitudinal axis of said grounding elements, wherein a bandwidth and a resonant frequency of said current probe is dependent on said frequency angle θ.

16. The system of claim 15, wherein said plurality of grounding elements are a plurality of metallic strip-shaped grounding elements non-movably affixed to an outer surface of said housing.

17. The system of claim 15, wherein said plurality of grounding elements are a plurality of streams of electrolytic fluid, wherein each stream is expelled through an aperture of a nozzle, and wherein said nozzles are connected at an adjustable frequency angle θ to a manifold which is non-movably affixed to an outer surface of said housing.

18. A method for making a grounded mast current clamp probe apparatus, said method comprising:

providing a current probe, said current probe including a magnetic core formed with an aperture and a conductive structure positioned in said aperture;

substantially enclosing said current probe within at least one housing, wherein said housing forms an electrostatic shield that prevents passage of electricity to or from said current probe;

connecting a plurality of grounding elements to an outer surface of said housing such that said grounding elements radiate outwardly from an outer circumference of said housing, wherein each of said grounding elements radiates at a frequency angle θ ranging from about 40 degrees to about 45 degrees; and, wherein said frequency angle θ is an angle formed between a longitudinal axis of said housing and a longitudinal axis of said grounding elements, wherein a bandwidth and a resonant frequency of said current probe is dependent on said frequency angle θ.

* * * * *